US005357856A

United States Patent [19]

Hasegawa et al.

[11] Patent Number: 5,357,856

[45] Date of Patent: Oct. 25, 1994

[54] SQUEEGE DEVICE FOR SUPPLYING INK IN A STENCIL PRINTING DEVICE

[75] Inventors: Takanori Hasegawa; Junnosuke Katsuyama, both of Tokyo, Japan

[73] Assignee: Riso Kagaku Corporation, Tokyo, Japan

[21] Appl. No.: 942,461

[22] Filed: Sep. 9, 1992

[30] Foreign Application Priority Data

Sep. 13, 1991 [JP] Japan ..... 3-235130

[51] Int. Cl.[5] ..... B41L 13/00

[52] U.S. Cl. ..... 101/120; 101/119

[58] Field of Search ..... 101/120, 119, 116

[56] References Cited

U.S. PATENT DOCUMENTS

| | | | |
|---|---|---|---|
| 3,155,034 | 11/1964 | Reinke | 101/120 |
| 4,030,410 | 6/1977 | Zimmer | 101/120 |
| 4,138,943 | 2/1979 | Mitter | 101/120 |
| 4,188,882 | 2/1980 | Jeschke et al. | 101/366 |
| 5,095,816 | 3/1992 | Hasegawa et al. | 101/119 |

FOREIGN PATENT DOCUMENTS

| | | | |
|---|---|---|---|
| 349498 | 4/1979 | Austria . | |
| 0577636 | 5/1933 | Fed. Rep. of Germany | 101/120 |
| 3812826 | 1/1989 | Fed. Rep. of Germany . | |
| 8805911 | 8/1989 | Fed. Rep. of Germany . | |
| 4215923 | 11/1992 | Fed. Rep. of Germany . | |
| 0504394 | 7/1920 | France | 101/120 |
| 0228982 | 10/1986 | Japan | 101/120 |
| 0630559 | 6/1982 | Switzerland | 101/120 |
| 713583 | 8/1954 | United Kingdom . | |
| 857874 | 1/1961 | United Kingdom . | |
| 1310623 | 3/1973 | United Kingdom . | |
| 1553709 | 10/1979 | United Kingdom . | |

*Primary Examiner*—Edgar S. Burr
*Assistant Examiner*—Anthony H. Nguyen
*Attorney, Agent, or Firm*—Dickstein, Shapiro & Morin

[57] ABSTRACT

In a squeegee device for supplying ink in a stencil printing device from the interior of a cylindrical, ink permeable printing drum which rotates around an axial line thereof with a stencil master plate wrapped around the outer circumferential surface thereof, to prevent a squeegee blade from developing a juddering movement relative to the cylindrical printing drum, and to allow the squeegee blade to sufficiently intimately contact the inner circumferential surface of the printing drum so that printing ink may be supplied to the printing drum by a prescribed amount in a stable fashion at all times, a thin spring plate is placed on a reverse surface of the squeegee blade made of a rubber-like elastic material which is in engagement with the inner circumferential surface of the cylindrical printing drum. The spring property of the thin spring plate appropriately controls the elastic deformation of the squeegee blade, and, even when the squeegee blade is made of readily deformable rubber-like elastic material, and the increase in the rotational speed of the cylindrical printing drum is increased, the squeegee blade is prevented from developing a juddering movement relative to the cylindrical printing drum.

8 Claims, 1 Drawing Sheet

SQUEEGE DEVICE FOR SUPPLYING INK IN A STENCIL PRINTING DEVICE

TECHNICAL FIELD

The present invention relates to a squeegee device for supplying ink in a stencil printing device, and in particular to a squeegee device for supplying ink in a rotary stencil printing device.

BACKGROUND OF THE INVENTION

A rotary stencil printing device comprises a cylindrical, ink permeable printing drum which rotates around an axial line thereof with a stencil master plate wrapped around the outer circumferential surface thereof, and a desired printing can be accomplished by pushing printing paper conveyed in synchronism with the rotation of the printing drum against the stencil master plate on the outer circumferential surface of the printing drum by using a press roller.

In such a rotary stencil printing device, printing ink is continually supplied to the printing drum from the inner circumferential surface thereof. As means for supplying printing ink in such a manner, the applicant of the present application previously proposed in Japanese patent laid open publication No. 02-37178 a squeegee device for supplying ink which pushes printing ink onto the inner circumferential surface of the printing drum by using a squeegee blade made of rubber-like elastic material which engages with the inner circumferential surface of the cylindrical printing drum and is stationary relative to the printing drum undergoing a rotary motion.

The squeegee device for supplying ink by using a squeegee blade made of rubber-like elastic material is relatively simple in structure as compared with the ink supply device of a rotary roller type using a squeegee roller, a doctor roller or the like, and has a number of advantages. However, as the rotational speed of the cylindrical printing drum increases for increased printing speed, the squeegee blade tends to develop a juddering movement or a vibration of a small amplitude, and it leads to the inconvenience that the contact pressure acting between the squeegee blade and the cylindrical printing drum is subjected to fluctuation.

Such fluctuation in the contact pressure between the squeegee blade and the cylindrical printing drum causes corresponding fluctuation in the amount of ink supply to the printing drum which in turn causes fluctuations in the density of the printed images.

Juddering of a squeegee blade diminishes as the hardness of the rubber-like material making up the squeegee blade is increased, but cannot be entirely eliminated. Further, when the hardness of the rubber-like material making up the squeegee blade is increased for reducing the tendency of the squeegee blade to judder, the intimacy of the contact between the squeegee blade and the inner circumferential surface of the printing drum tends to diminish due to the reduced tendency of the squeegee blade to undergo elastic deformation, and this leads to the unevenness of the amount of ink supply to the printing drum and the corresponding unevenness in the density of the printed images.

BRIEF SUMMARY OF THE INVENTION

In view of such shortcomings of the prior art, a primary object is to provide a squeegee device for supplying ink in a stencil printing device which is free from the juddering of the squeegee blade relative to the cylindrical printing drum even when the rotational speed of the printing drum is increased for high speed printing.

A second object of the present invention is to allow the squeegee blade to sufficiently intimately contact the inner circumferential surface of the printing drum so that printing ink may be supplied to the printing drum by a prescribed amount in a stable fashion without regard to the rotational speed of the printing drum.

A third object of the present invention is to provide simple means for improving the performance of a squeegee device for supplying ink in a stencil printing device from the interior of a cylindrical, ink permeable printing drum which rotates around an axial line thereof with a stencil master plate wrapped around the outer circumferential surface thereof.

These and other objects of the present invention can be accomplished by providing a squeegee device for supplying ink in a stencil printing device from the interior of a cylindrical, ink permeable printing drum which rotates around an axial line thereof with a stencil master plate wrapped around the outer circumferential surface thereof, comprising: a squeegee blade made of a rubber-like elastic material which is in engagement with the inner circumferential surface of the cylindrical printing drum at its free end; clamping means for securing a base end of the squeegee blade to a mounting base, a certain length of the free end of the squeegee blade extending beyond the mounting base; and spring means for elastically supporting the length of the free end of the squeegee blade extending beyond the mounting base. Preferably, the spring means consists of a thin spring plate extending along a reverse surface of at least a part of the length of the squeegee blade extending beyond the mounting base.

According to such a structure, the thin spring plate serves as a back-up plate for the squeegee blade made of rubber-like material, and the spring property of the thin spring plate appropriately controls the elastic deformation of the squeegee blade in such a manner that the squeegee blade, even though it is made of relatively readily deformable rubber-like elastic material, is prevented from undergoing a juddering movement even when the rotational speed of the cylindrical printing drum is high. Thus, the squeegee blade may be made of relatively readily deformable rubber-like elastic material so that the squeegee blade may achieve a sufficiently intimate contact with the inner circumferential surface of the cylindrical printing drum by virtue of the elastic deformation of the part of the squeegee blade engaging with the inner circumferential surface of the cylindrical printing drum.

According to a structurally preferable embodiment, the clamping means comprises a clamp piece extending over a front surface of the base end of the squeegee blade, and a threaded bolt passed through the clamp piece, the squeegee blade, the spring plate, and the mounting base.

BRIEF DESCRIPTION OF THE DRAWINGS

Now the present invention is described in the following with reference to the appended drawing, in which.

DETAILED DESCRIPTION OF THE PREFERRED EMBODIMENTS

Figure 1:
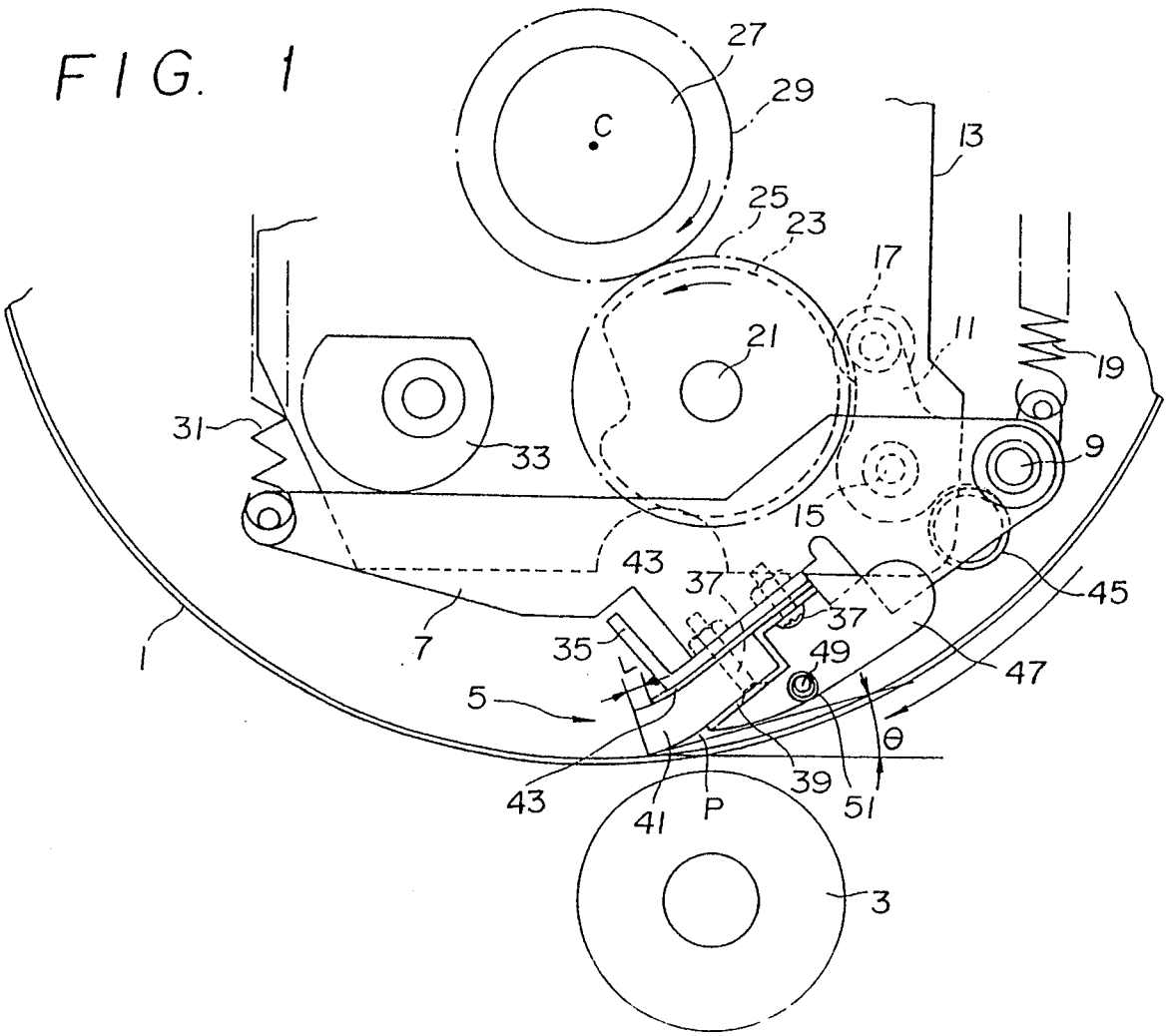
FIG. 1 is a simplified side view of an embodiment of the squeegee device for supplying ink in a stencil printing device according to the present invention.

FIG. 1 shows an embodiment of the squeegee device for supplying ink in a stencil printing device. In the drawing, numeral 1 denotes a cylindrical printing drum. The cylindrical printing drum 1 may be made of such ink permeable material as porous metallic plate or a member consisting of a mesh structure, and a stencil master plate not shown in the drawing is mounted on the outer circumferential surface thereof.

The cylindrical printing drum 1 is rotatively driven around its central axial line C in the clockwise direction as seen in the drawing by printing drum rotatively driving means, and printing paper not shown in the drawing is conveyed through the nip between a press roller 3 and the printing drum 1 from right to left as seen in the drawing in synchronism with the rotation of the cylindrical printing drum 1 so that the printing paper may be pressed against the stencil master plate wrapped around the cylindrical printing drum 1, and a desired print may be made on the printing paper.

The interior of the cylindrical printing drum 1 is provided with a squeegee device 5 for supplying ink. The squeegee device 5 for supplying ink is provided with a pair of laterally opposing squeegee support side plates 7 which are integrally joined together at their one ends by a connecting shaft 9 which extends in the axial direction of the cylindrical printing drum 1. The connecting shaft 9 pivotally supports one end of a swing lever 11. The swing lever 11 is pivotally supported by a support shaft 15 mounted on a fixed frame 13 at a middle part thereof, and rotatably supports a cam follower roller 17 in a rotatable manner at the other end thereof.

The cam follower roller 17 engages with a cam surface of a cam 23 secured to a camshaft 21 rotatably supported by the fixed frame 13 by being urged in counter-clockwise direction as seen in the drawing by a tension coil spring 19 engaged to the connecting shaft 9. The camshaft 21 carries a gear 25 which meshes with another gear 29 mounted on a printing drum drive shaft 27 which is disposed coextensively with respect to the central axial line C of the cylindrical printing drum 1 so that the camshaft 21 may be rotatively driven on a one-to-one basis in synchronism with the rotation of the cylindrical printing drum 5.

The squeegee support side plates 7 are urged upward by a tension coil spring 31 in the sense of the drawing at its other end and engaged by an eccentric cam 33 so that the squeegee support side plates 7 may be secured to the fixed frame 13, and their mounting angle may be adjusted.

The above described structure including the cam structure forces the squeegee support side plates 7 along with the squeegee blade 41 associated therewith as described hereinafter away from the inner circumferential surface of the cylindrical printing drum 1 during the phase of the rotation of the cylindrical printing drum 1 corresponding to the starting end of the non-ink permeable part of the stencil master plate clamping unit formed in a part of the cylindrical printing drum for the purpose of preventing the printing ink from leaking out of a terminal edge of the stencil master plate mounted on the outer circumferential surface of the cylindrical printing drum 1.

A squeegee support base plate 35 and a squeegee mounting plate 39 which is fixedly secured to the squeegee support base plate 35 by means of screws 37 are mounted across the squeegee support side plates 7 in parallel with the axial line of the cylindrical printing drum 1. The squeegee support base plate 35 and the squeegee mounting plate 39 securely clamp therebetween the base end of the squeegee blade 41 extending in parallel with the axial line of the cylindrical printing drum 1.

The squeegee blade 41 consists of rubber-like material such as urethane rubber having a hardness of 50 to 70 (Shore), and a thickness of 6 to 10 mm, preferably 8 mm, and engages the inner circumferential surface of the cylindrical printing drum 1 defining a prescribed squeegee angle $\theta$ at its free end or its leading edge by being supported by the squeegee support base plate 35 and the squeegee mounting plate 39 in the manner of a cantilever.

The pressure acting between the squeegee blade 41 and the inner circumferential surface of the printing drum 1 can be varied by adjusting the mounting angle of the eccentric cam 33, and the inclination angle of the squeegee support side plates 7 around the connecting rod 9.

A thin spring plate 43 made of stainless steel having a thickness of 0.1 to 0.2 mm is placed on the reverse surface or the upper surface of the squeegee blade 41. The base end of the thin spring plate 43 is clamped between the squeegee support base plate 35 and the squeegee mounting plate 39 along with the squeegee blade 41 in the manner of a cantilever. The distance L between the free end of the spring plate 43 and the free end of the squeegee blade 41 may be appropriately determined according to the hardness and the thickness of the squeegee blade 41 and the elastic modulus of the spring plate 43 so as to achieve a favorable printing result, and could be substantially zero if so determined.

The squeegee blade 41 forms a lump of ink or an ink reservoir P from the printing ink supplied from an ink supply pipe 45 in a triangular region on the left hand side of the ink supply pipe 45 as seen in FIG. 1 as the cylindrical printing drum 1 rotates, and an ink stirring pipe 51 rotatably supported by a support rod 49 extending across the lateral side plates 47 of the squeegee mounting plate 39 in parallel with the axial line of the cylindrical printing drum 1 is disposed in this ink reservoir P.

According to the above described structure, as the cylindrical printing drum 1 rotates in clockwise direction as seen in the drawing, the free end of the squeegee blade 41 engages with the inner circumferential surface of the cylindrical printing drum 1, and the printing ink in the ink reservoir P rotatably drags the ink stirring pipe 51 by virtue of its viscosity as the cylindrical printing drum 1 rotates in clockwise direction as seen in FIG. 1, causing clockwise vortices to be developed in the printing ink around the stirring pipe 51. The printing ink is moved laterally (in the axial direction of the ink stirring pipe 51) so as to uniformly distribute the printing ink in the lateral direction by virtue of the vortices generated around the ink stirring pipe 51, and is pushed into the cylindrical printing drum 1 from the free end of the squeegee blade 41 which engages with the inner circumferential surface of the cylindrical printing drum 1 before it is ultimately supplied to the reverse surface of the stencil master plate mounted on the outer circumferential surface of the cylindrical printing drum 1.

When the printing ink is being supplied to the cylindrical printing drum 1 by the squeegee blade 41, the spring plate 43 serves as a back-up plate for the squeegee blade 41 so that the elastic deformation of the free end of the squeegee blade 41 away from the inner circumferential surface of the cylindrical printing drum 1 is appropriately controlled, and, even when the squeegee blade is made of relatively readily deformable rubber-like elastic material, it is prevented from undergoing a vibratory movement with the increase in the rotational speed of the printing drum 1. Thus, the squeegee blade 41 is prevented from undergoing a juddering movement relative to the cylindrical printing drum 1, and the free end of the squeegee blade 41 is allowed to contact the inner circumferential surface of the cylindrical printing drum 1 with a sufficient intimacy by virtue of the local deformation of the free end of the squeegee blade 41 engaging the inner circumferential surface of the printing drum 1 without involving any fluctuations in the contact pressure between the squeegee blade 41 and the inner circumferential surface of the cylindrical printing drum 1 so as to achieve a stable supply of ink and form stencil print images of a uniform density.

The spring plate 43 may be made of plastic material having a suitable spring property instead of metallic material, and, although the spring plate was provided with a constant thickness and a constant elastic coefficient along the length of the squeegee blade 41 in the above described embodiment, the free end of the squeegee blade 41 may be given with a reduced rigidity toward the free end thereof by changing the thickness or the material, or forming perforations. The spring plate 43 may be embedded in the squeegee blade 41 one over the other for instance by insert molding.

As can be understood from the above description, according to the squeegee device for supplying ink in a stencil printing device, since the thin spring plate serves as a back-up plate for the squeegee blade made of rubber-like elastic material, the elastic deformation of the squeegee blade is appropriately controlled by this spring property, and even when the squeegee blade is made of relatively readily deformable rubber-like elastic material, it is prevented from undergoing a vibratory movement with the increase in the rotational speed of the printing drum. Therefore, the contact pressure between the squeegee blade and the inner circumferential surface of the printing drum can be kept constant, and the squeegee blade is capable of intimate contact with the inner circumferential surface of the printing drum by virtue of the elastic deformation of the part of the squeegee blade contacting the inner circumferential surface of the printing drum, so that printing ink can be supplied to the cylindrical printing drum always by a prescribed amount, and, accordingly, high quality stencil print images of uniform density can be obtained even when the rotational speed of the cylindrical printing drum is increased.

Although the present invention has been described in terms of a specific embodiment, it is possible to modify and alter details thereof without departing from the spirit of the present invention.

What we claim is:

1. A squeegee device for supplying ink in a stencil printing device from the interior of a cylindrical, ink permeable printing drum which rotates around an axial line thereof with a stencil master plate wrapped around the outer circumferential surface thereof, comprising:

a squeegee blade having a free end and a base end, said squeegee blade being made of a rubber-like elastic material, said free end of said squeegee blade being in engagement with the inner circumferential surface of said cylindrical printing drum, said free end of said squeegee blade having a reverse surface, said squeegee blade having a thickness;

a mounting base, and clamping means for securing said base end of said squeegee blade to said mounting base, a certain length of said free end of said squeegee blade extending beyond said mounting base; and a spring plate extending along said reverse surface of said squeegee blade, said spring plate extending beyond said mounting base, said spring plate comprising metal and having a thickness less than said thickness of said squeegee blade.

2. A squeegee device according to claim 1, wherein said base end of said squeegee blade has a front surface, and wherein said clamping means comprises a clamp piece extending over said front surface of said base end of said squeegee blade, and a threaded bolt passed through said clamp piece, said squeegee blade, said spring plate, and said mounting base.

3. A squeegee device for supplying ink in a stencil printing device from the interior of a cylindrical, ink permeable printing drum which rotates around an axial line thereof with a stencil master plate wrapped around the outer circumferential surface thereof, comprising:

a squeegee blade having a free end and a base end, said squeegee blade being made of a rubber-like elastic material, said free end of said squeegee blade being in engagement with the inner circumferential surface of said cylindrical printing drum, said squeegee blade having a thickness;

a mounting base, and clamping means for securing said base end of said squeegee blade to said mounting base, a certain length of said free end of said squeegee blade extending beyond said mounting base; and spring means for elastically supporting said free end of said squeegee blade, said spring means extending beyond said mounting base, said spring means comprising metal and having a thickness less than said thickness of said squeegee blade.

4. A squeegee device according to claim 1, wherein said squeegee blade and said spring plate are sized and arranged such that said spring plate is elastically deformed by said squeegee blade during said engagement of said free end of said squeegee blade with said inner circumferential surface of said cylindrical printing drum.

5. A squeegee device according to claim 3, wherein said spring means includes a metal plate having a thickness of 0.1 to 0.2 mm.

6. A squeegee device according to claim 3, wherein said spring plate is formed of an elastically deformable plastic material.

7. A squeegee device for supplying ink in a stencil printing device from the interior of a cylindrical, ink permeable printing drum which rotates around an axial line thereof with a stencil master plate wrapped around the outer circumferential surface thereof, comprising:

a squeegee blade having a free end and a base end, said squeegee blade being made of a rubber-like elastic material, said free end of said squeegee blade being in engagement with the inner circumferential surface of said cylindrical printing drum, said free end of said squeegee blade having a reverse surface, said squeegee blade having a thickness;

a mounting base, and clamping means for securing said base end of said squeegee blade to said mounting base, a certain length of said free end of said squeegee blade extending beyond said mounting base;

a spring plate extending along said reverse surface of said squeegee blade, said spring plate extending beyond said mounting base, and wherein said spring plate has a thickness less than said thickness of said squeegee blade; and pressure changing means for changing the pressure between said free end of said squeegee blade and said inner circumferential surface of said cylindrical printing drum.

8. A squeegee device according to claim 7, wherein said spring plate comprises metal.

* * * * *